US008406643B2

(12) United States Patent
Funayama et al.

(10) Patent No.: US 8,406,643 B2
(45) Date of Patent: Mar. 26, 2013

(54) IMAGE FORMING APPARATUS, METHOD, AND PROGRAM STORAGE MEDIUM

(75) Inventors: Hiroyuki Funayama, Kanagawa (JP); Naoki Hirako, Kanagawa (JP); Hideo Kimura, Kanagawa (JP); Keita Kumokiri, Kanagawa (JP); Mitsugu Kamio, Kanagawa (JP); Shun Kuwahara, Kanagawa (JP); Izumi Suda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 626 days.

(21) Appl. No.: 12/558,612

(22) Filed: Sep. 14, 2009

(65) Prior Publication Data

US 2010/0221024 A1 Sep. 2, 2010

(30) Foreign Application Priority Data

Feb. 27, 2009 (JP) ..... 2009-046194

(51) Int. Cl.
*G03G 15/00* (2006.01)
*G03G 15/22* (2006.01)

(52) U.S. Cl. ..... 399/46; 399/16; 399/49; 399/165; 399/301

(58) Field of Classification Search ..... 399/16, 399/18, 46, 49, 50, 53, 66, 72, 159, 162, 399/165, 297, 299, 301–303
See application file for complete search history.

(56) References Cited

U.S. PATENT DOCUMENTS

| | | | | |
|---|---|---|---|---|
| 2007/0025780 | A1* | 2/2007 | Kurosu et al. | 399/313 |
| 2007/0122210 | A1* | 5/2007 | Sato et al. | 399/301 |
| 2007/0242965 | A1* | 10/2007 | Akamatsu | 399/49 |
| 2008/0075496 | A1 | 3/2008 | Okamoto et al. | |

FOREIGN PATENT DOCUMENTS

| | | | |
|---|---|---|---|
| JP | 2000-221738 | A | 8/2000 |
| JP | 2006-162745 | A | 6/2006 |
| JP | 2007-148248 | A | 6/2007 |
| JP | 2008-83253 | A | 4/2008 |
| JP | 2010-91806 | A | 4/2010 |

OTHER PUBLICATIONS

Notification of Reasons for Rejection, Japanese Application No. 2009-46194; Jan. 22, 2013.

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes an image formation unit, a conveying unit and controller. The image formation unit includes a rotating photoreceptor, a latent image formation unit, a developing unit, a first transfer unit, and a second transfer unit. Regardless of forming or not forming on the photoreceptor a belt-shaped image which is not being transferred onto a recording medium, the controller controls the image forming unit such that formation of an image quality adjusting image that is not transferred to the recording medium starts from a predetermined position in a rotational direction of the photoreceptor, and such that the recorded image is formed further downstream in the rotational direction of the photoreceptor than an image quality adjusting image region.

7 Claims, 10 Drawing Sheets

IMAGE FORMING APPARATUS, METHOD, AND PROGRAM STORAGE MEDIUM

CROSS-REFERENCE TO RELATED APPLICATIONS

This application is based on and claims priority under 35 USC 119 from Japanese Patent Application No. 2009-046194 filed on Feb. 27, 2009.

BACKGROUND

1. Technical Field

The present invention relates to an image forming apparatus, image forming method, and a computer-readable storage medium storing an image forming program.

2. Related Art

There has been conventionally proposed an image forming apparatus having plural photosensitive drums and provided with a home position sensor to a photosensitive drum to generate correcting patches in the same positions of the photosensitive drum.

SUMMARY

According to one aspect of the invention, an image forming apparatus including: an image formation unit that includes a rotating photoreceptor, a latent image formation unit that forms an electrostatic latent image of a recorded image on the photoreceptor, a developing unit that develops the electrostatic latent image using a developer, a first transfer unit that transfers the developed image from the photoreceptor to a receiving member, and a second transfer unit that transfers the image on the receiving member to a recording medium at a transfer position; a conveying unit that conveys the recording medium to the transfer position; and a controller that performs control when a belt-shaped image is formed on the photoreceptor, or when the belt-shaped image is not formed the photoreceptor, the belt-shaped image forcefully discharging the developer in the developing unit from the developing unit, the belt-shaped image not being transferred onto the recording medium, the control including: (A) controlling the image forming unit such that formation of an image quality adjusting image that is not transferred to the recording medium starts from a predetermined position in a rotational direction of the photoreceptor, and such that the recorded image is formed further downstream in the rotational direction of the photoreceptor than an image quality adjusting image region in which the image quality adjusting image is formed; and (B) controlling the conveying unit such that the recorded image is transferred onto the recorded medium at the transfer position by the second transfer unit.

BRIEF DESCRIPTION OF THE DRAWINGS

Exemplary embodiments of the present invention will be described in detail based on the following figures, wherein.

DETAILED DESCRIPTION

Figure 1:
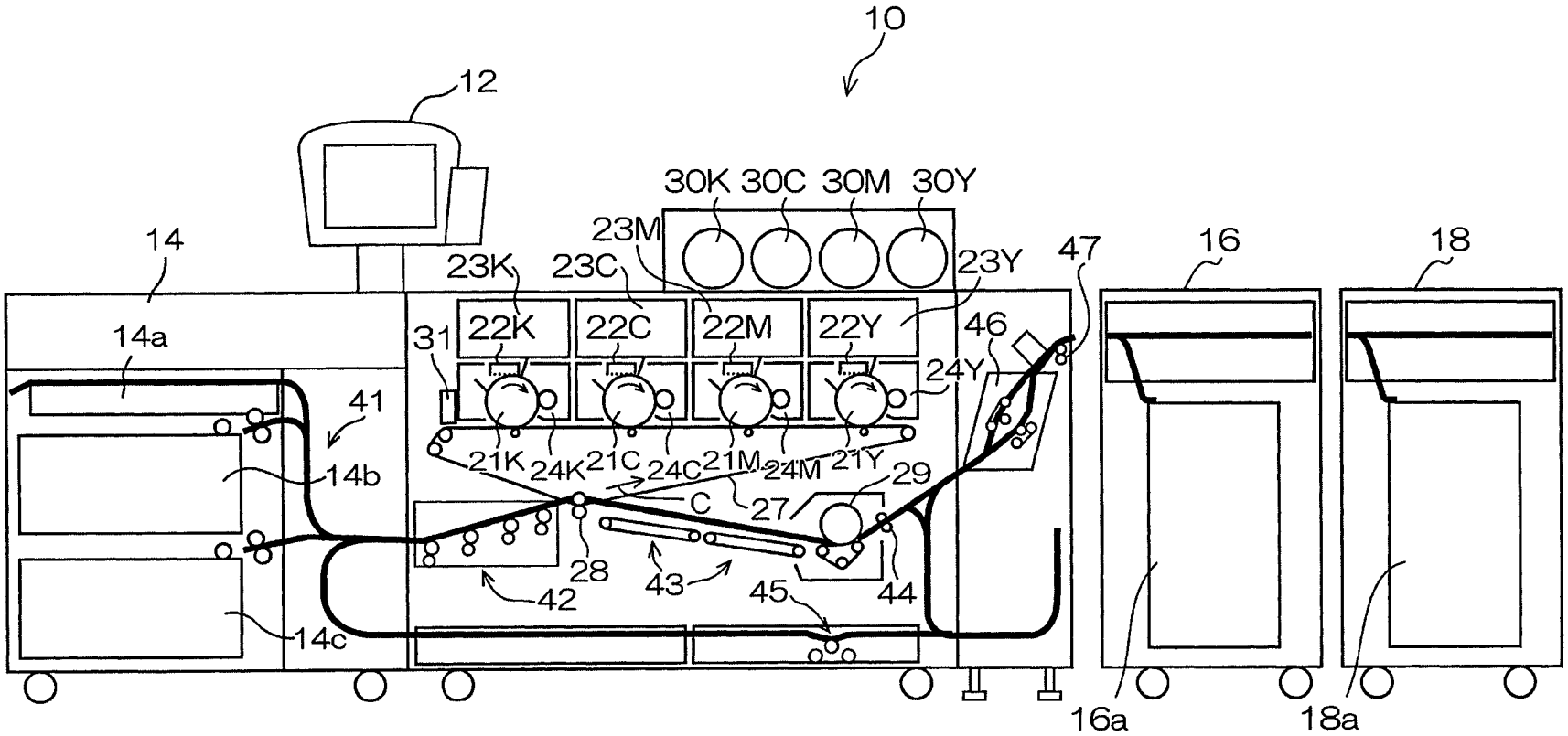
FIG. 1 is a diagram illustrating an example of the entire configuration of an image forming apparatus according to an exemplary embodiment.

FIG. 1 is a diagram illustrating an example of the entire configuration of an image forming apparatus 10 according to the exemplary embodiment. The image forming apparatus 10 employs a tandem type electrophotographic system that forms a color image by overlapping images of yellow (Y), magenta (M), cyan (C), and black (K) colors.

Figure 2:
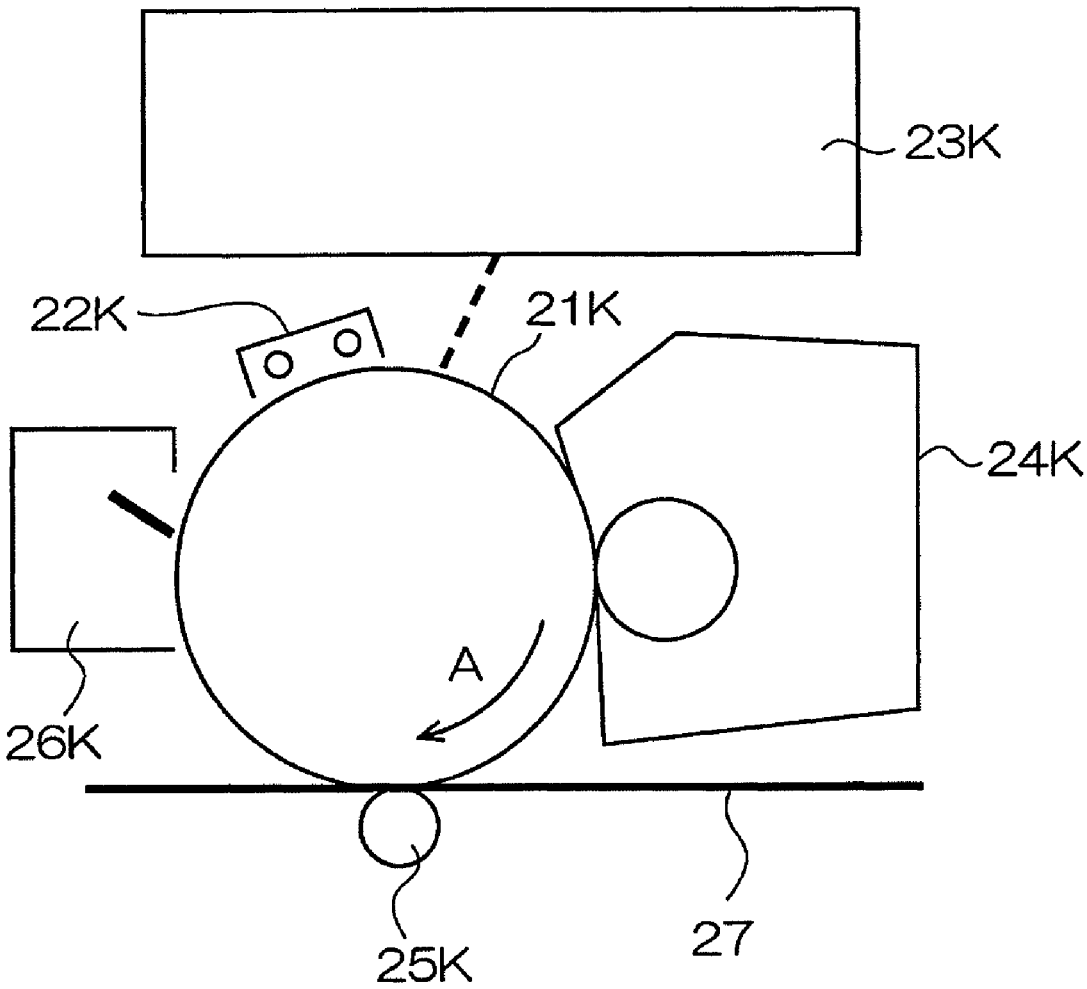
FIG. 2 is an explanatory view of a photoreceptor of a K color included in the image forming apparatus and components arranged therearound.
Figure 3A:
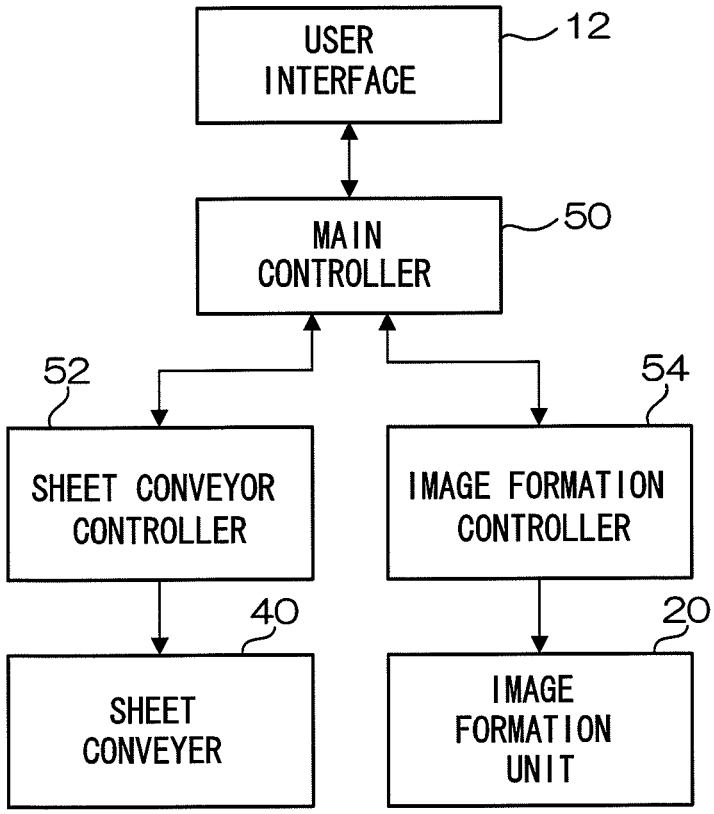
FIGS. 3A and 3B are block diagrams illustrating examples of the configurations of the control system of the image forming apparatus.
Figure 3B:
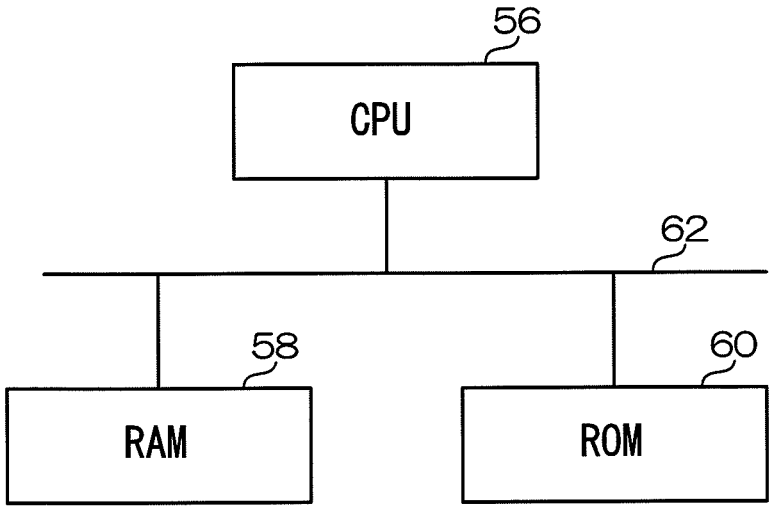

FIG. 2 is an explanatory view of a photoreceptor included in the image forming apparatus 10 and components arranged therearound. Here, a photoreceptor 21K of K color and components therearound are illustrated as a representative. FIGS. 3A and 3B are block diagrams illustrating examples of the configuration of the control system of the image forming apparatus 10.

As shown in FIG. 3A, the image forming apparatus 10 has a user interface 12 that includes a display which displays information to the user and an operation section which is operated by the user, a main controller 50 that controls the entire image forming apparatus 10, an image formation unit 20 that forms an image on a conveyed recording medium (in the exemplary embodiment, a sheet), an image formation controller 54 that controls the operation of the image formation unit 20, a sheet conveyor 40 that conveys the sheet to the image formation unit 20, and a sheet conveyor controller 52 that controls the operation of the sheet conveyor 40.

The image formation unit 20 has four photoreceptors 21Y, 21M, 21C, and 21K that are rotated in an arrow A direction in FIGS. 1 and 2, charging devices 22Y, 22M, 22C, and 22K that charge the surfaces of the photosensitive members by applying a charging bias (voltage), laser beam emission units 23Y, 23M, 23C, and 23K that expose the charged surfaces of the photoreceptors to a laser beam modulated according to image information (data) of the respective colors and form electrostatic latent images on the photoreceptors, developing devices 24Y, 24M, 24C, and 24K that house developers (toner) of the respective colors and perform development by attracting the developers of the respective colors onto the electrostatic latent images on the photoreceptors by applying a developing bias (voltage), primary transferring devices 25Y, 25M, 25C, and 25K that transfer the developed images on the photoreceptors to an intermediate transfer member 27 which cyclically travels in an arrow C direction (only the 25K is illustrated in FIG. 2 and others are not illustrated for simplification), cleaning units 26Y, 26M, 26C, and 26K that clean the surfaces of the photoreceptors (only the 26K is illustrated in FIG. 2 and others are not illustrated for simplification), a secondary transferring device 28 that transfers the image transferred on the intermediate transfer member 27 to a sheet, a fixing device 29 that fixes the image transferred on the sheet, cartridges 30Y, 30M, 30C, and 30K that supply the developers of the respective colors to the developing devices 24Y, 24M, 24C, and 24K, an electricity removing device (not illustrated) that emits a light for removing (electricity removing) the remaining charge on the surfaces of the photoreceptors, a detector 31 that detects the images transferred onto the surface of the intermediate transfer member 27, and a cleaning unit (not illustrated) that cleans the developers remaining on the surface of the intermediate transfer member 27.

As illustrated in FIG. 1, the sheet conveyor 40 has a sheet feeding roll 41 that takes out a sheet from a storage 14 and conveys the sheet, a conveying roll 42 that conveys the sheet taken out from the storage 14 toward a transfer position of the secondary transferring device 28, a conveying roll 43 that conveys the sheet onto which an image is transferred by the secondary transferring device 28 to the fixing device 29, a conveying roll 44 that conveys the sheet onto which the image is fixed by the fixing device 29 to a curl correcting unit 46 for correcting (straightening) the curl of the sheet, a reversing path conveying roll 45 that is provided on a reversing path for reversing the sheet to form the image on both sides of the sheet, a discharge roll 47 that conveys the sheet whose curl is corrected by the curl correcting unit 46 toward postprocessing devices 16 and 18, and a motor (not illustrated) driving the respective rolls. The thick line in FIG. 1 indicates a path in which the sheet is conveyed.

The storage 14 has a first storage portion 14*a*, a second storage portion 14*b*, and a third storage portion 14*c* that respectively store sheets having different size. Alternately, all of the first storage portion 14*a*, the second storage portion 14*b*, and the third storage portion 14*c* may store sheets having the same size.

The postprocessing devices 16 and 18 connected to the image forming apparatus 10 perform predetermined postprocessing to a sheet discharged from the image forming apparatus 10. The sheet subjected to the postprocessing is discharged to and stored in discharged sheet storage portions 16*a* and 18*a* provided in the postprocessing devices 16 and 18.

As illustrated in FIG. 3B, each of the main controller 50, the sheet conveyor controller 52, and the image formation controller 54 has a Central Processing Unit (CPU) 56, a Random Access Memory (RAM) 58, and a Read Only Memory (ROM) 60, which are connected via a bus 62. The CPU 56 may execute a program stored in the ROM 60. The RAM 58 may be used as a work memory. Each of the main controller 50, the sheet conveyor controller 52, and the image formation controller 54 has a connection interface for transmitting and receiving information with each other, which is not illustrated.

The operation of forming an image on a sheet in the image forming apparatus 10 will be briefly described. The surfaces of the photoreceptors 21Y, 21M, 21C, and 21K are charged to a predetermined charging potential by applying charging bias (voltage) from a power source to the charging devices 22Y, 22M, 22C, and 22K. The developing bias (voltage) is applied to the developing devices 24Y, 24M, 24C, and 24K of the respective colors so as to be a predetermined developing potential from the power source, when the surfaces of the photoreceptors 21Y, 21M, 21C, and 21K charged by the charging devices 22Y, 22M, 22C, and 22K reach the positions of the developing devices 24Y, 24M, 24C, and 24K of the colors.

The laser beam emission units 23Y, 23M, 23C, and 23K emit a laser beam to the surfaces of the photoreceptors 21Y, 21M, 21C, and 21K charged by the charging devices 22Y, 22M, 22C, and 22K in accordance with image data.

Due to the laser beam raster scans (irradiates) the surface of each of the photoreceptors 21Y, 21M, 21C, and 21K, an electrostatic latent image is formed on each of the photoreceptors 21Y, 21M, 21C, and 21K. Next, the electrostatic latent image on each of the photoreceptors 21Y, 21M, 21C, and 21K is developed with toner by each of the developing devices 24Y, 24M, 24C, and 24K of respective colors, and a recorded image is formed on each of the photoreceptors 21Y, 21M, 21C, and 21K. The image formed on each of the photoreceptors is transferred to the intermediate transfer member 27 by the respective primary transferring devices 25Y, 25M, 25C, and 25K. In each of the photoreceptors that has completed the transfer of the image onto the intermediate transfer member 27, an adhesion such as the developer remaining on the surface is cleaned by the cleaning unit 26, and the remaining charge is removed by lighting of the electricity removing device.

A sheet onto which the image is transferred and recorded is taken out from any one of the first storage portion 14*a*, the second storage portion 14*b*, and the third storage portion 14*c* of the storage 14 by the sheet feeding roll 41 and is conveyed to the transfer position of the secondary transferring device 28 by the conveying roll 42. The image on the intermediate transfer member 27 is transferred onto the sheet at the transfer position by the secondary transferring device 28. The sheet is then conveyed to the fixing device 29 and the transferred image is fixed onto the sheet by the fixing device 29. The sheet subjected to the fixing is conveyed to the curl correcting unit 46 by the conveying roll 44 and its curl is straightened, and then is discharged to the discharged sheet storage portion 16*a* of the postprocessing device 16 or the discharged sheet storage portion 18*a* of the postprocessing device 18.

In this exemplary embodiment, in addition to an image transferred onto a sheet, an image quality adjusting image is formed.

In the image forming apparatus of an electrophotographic system, due to environmental conditions such as temperature and humidity and influences such as deterioration with time, image variation such as image density variation, offset of the respective color images, color reproduction and/or tone variations, and high background or fogging (toner adhesion at a non-intended position) may arise. Therefore, the image forming apparatus 10 performs image density adjustment and image position adjustment before the image formation on a sheet in order to prevent degrades of the image quality. Specifically, the image quality adjusting image, which is separate from an image to be transferred onto a sheet, and is used for image density adjustment and image position adjustment is formed on the intermediate transfer member 27. The formed image quality adjusting image is detected by the detector 31 and a detection signal is transmitted to the image formation controller 54. The image formation controller 54 performs image density adjustment and image position adjustment by changing the image formation conditions, if necessary, based on density variation and image shift amount obtained from the detection signal.

The adjustments may be performed by changing various image formation conditions such as the laser beam emission timing and laser power of the laser beam emission unit 23, the magnitude and timing of the charging bias of the charging device 22, the developing bias of the developing device 24, and the like.

The image quality adjusting image is formed by irradiating a laser beam according to image data of the image quality adjusting image onto the charged surface of each of the photoreceptors 21Y, 21M, 21C, and 21K and forming an electrostatic latent image, developing the electrostatic latent image by each of the developing devices 24Y, 24M, 24C, and 24K of the respective colors, and transferring the developed image onto the intermediate transfer member 27 by each of the primary transferring devices 25Y, 25M, 25C, and 25K, as described above. However, the image quality adjusting image is not transferred onto a sheet. After detection of the detector 31, the transferred image quality adjusting image is removed by the cleaning unit provided at the intermediate transfer member 27.

The detector 31 includes, for example, an optical sensor. The detector 31 may have a light emission unit that emits a light to the image quality adjusting image on the intermediate transfer member 27 or the surface of the intermediate transfer member 27, a lens, and a light receiving unit that receives a reflection light from the image quality adjusting image or the surface of the intermediate transfer member 27 via the lens. The light emission unit includes a LED and the light receiving unit includes a photodiode. Further, the detector 31 has a current-voltage converter that converts an electric current outputted from the light receiving unit to a voltage, and transmits the converted voltage to the image formation controller 54 as the detected result of the reflection light.

The image forming apparatus 10 of the exemplary embodiment also forms a belt-shaped image (solid image) on the photoreceptor 21 at a predetermined time, in order to forcefully discharge the developers from each of the developing devices 24Y, 24M, 24C, and 24K. The belt-shaped image is also an image that is not transferred onto the sheet as same as the image quality adjusting image.

For example, when images in which the amount of the developers used per sheet is small (i.e., the image density is low) are successively formed, the developers not contributing to the development may be adhered onto the developing devices 24Y, 24M, 24C, and 24K for a long time. Due thereto, the developers may be deteriorated because the electrostatic absorption force of the developers decreases and/or an external additive material added to the particle surface of the developers varies in its characteristics. Therefore, in the image forming apparatus 10 according to the exemplary embodiment, when a predetermined condition is met (for instance, when a predetermined time elapses after formation of the previous belt-shaped image, when the number of printed sheets reaches a predetermined number of sheets after formation of the previous belt-shaped image, or the like), an operation of forming the belt-shaped image on the photoreceptor 21 to forcefully discharge the developers is performed.

Hereinafter, an image transferred onto the sheet is called a recorded image in order to distinct it from the image quality adjusting image and the belt-shaped image. Further, when the distinction is not necessary, the recorded image, the image quality adjusting image, and the belt-shaped image are simply referred to as an image.

Further, since the elements indicated by the same reference numeral with reference characters of Y, M, C, and K at the ending are elements having the same function, when a distinction is not necessary for the elements of the Y, M, C, and K colors, the last reference characters of Y, M, C, and K are omitted from the reference numerals. On the other hand, when distinctions of the elements of the respective colors are necessary, the last reference characters of Y, M, C, and K are indicated at the ending of the reference numerals.

In the image forming apparatus 10, a region for arranging an image (hereinafter, referred to as an image placement region) is virtually set on the photoreceptor 21, and an image is placed and formed in the image placement region.

Figure 4A:
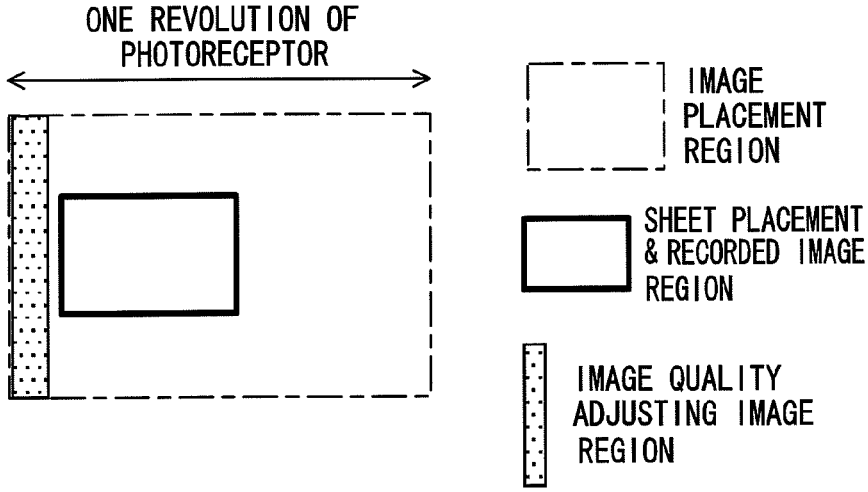
FIGS. 4A to 4C are diagrams illustrating arrangement examples of sheets (recorded images) and forming regions of image quality adjusting images with respect to image placement regions.
Figure 4B:
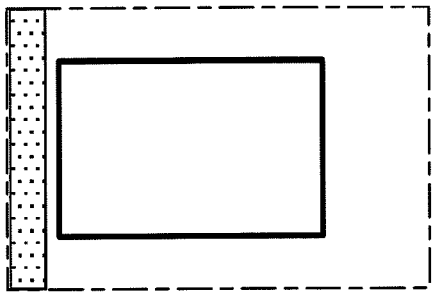
Figure 4C:
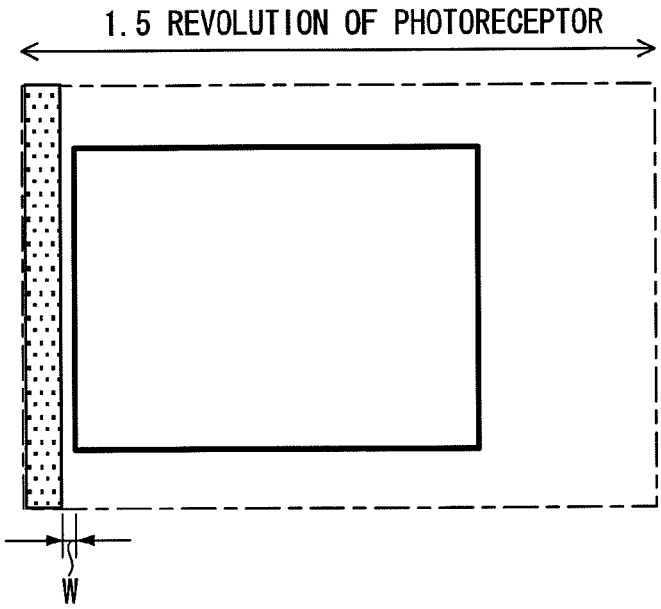

FIGS. 4A to 4C are diagrams illustrating examples of placements of sheets (recorded images) and forming regions of the image quality adjusting images with respect to the image placement regions. In this exemplary embodiment, the size of the sheet onto which the recorded image is to be transferred corresponds to the size of the recorded image.

In this exemplary embodiment, an image placement region having a width of one revolution of the photoreceptor in the rotational direction of the photoreceptor 21 is set as the smallest image placement region, and plural image placement regions, having widths in increments of 0.5 revolutions of the photoreceptor, may also be set.

For example, as illustrated in FIGS. 4A and 4B, if the size of the sheet can be accommodated in the image placement region having a width of one revolution of the photoreceptor, the image placement region having the width of one revolution of the photoreceptor is set. If the size of a sheet cannot be accommodated in the image placement region having the width of one revolution of the photoreceptor, but can be accommodated in the image placement region having a width of 1.5 revolution of the photoreceptor, the image placement region having the width of 1.5 revolution of the photoreceptor is set, as illustrated in FIG. 4C. Note that the sizes of the image placement regions are merely examples and the embodiments are not limited to this.

As illustrated in FIGS. 4A to 4C, a region (an image quality adjusting image region) in which the image quality adjusting image is formed is arranged along, one side of a pair of sides of the image placement region which are orthogonal to the rotational direction of the photoreceptor 21, and which the one side is at the upstream side in the rotational direction of the photoreceptor 21. The recorded image is formed at the downstream side in the rotational direction of the photoreceptor 21 from than the image quality adjusting image region. In this exemplary embodiment, in a case in which the belt-shaped image is not formed, the recorded image is formed at a position spaced from the image quality adjusting image region with a space region having a predetermined width w. Image quality can be maintained by forming the image quality adjusting image each time before the formation of the recorded image.

In the exemplary embodiment, since image data of the image quality adjusting image is fixed without depending on the size of the sheet and the recorded image, the width of the image quality adjusting image region in the rotational direction of the photoreceptor 21 is constant. Therefore, the size of the image placement region to be set is determined based on the size of the sheet.

In the exemplary embodiment, the belt-shaped image is formed at the image placement region virtually set at the time of forming the belt-shaped image. Specifically, the image quality adjusting image, the belt-shaped image, and the recorded image are formed in this order from the upstream side in the rotational direction of the photoreceptor 21. The belt-shaped image is placed and formed in the image placement region at the downstream side in the rotational direction of the photoreceptor 21 than the image quality adjusting image region and at the upstream side in the rotational direction of the photoreceptor 21 than the region in which the recorded image is formed (i.e., the recorded image region). In the exemplary embodiment, in a case in which the belt-shaped image is formed together with the recorded image, the recorded image is formed at a position spaced from a region in which the belt-shaped image is formed (i.e., the belt-shaped image region) with the space region having the predetermined width w.

Figure 5:
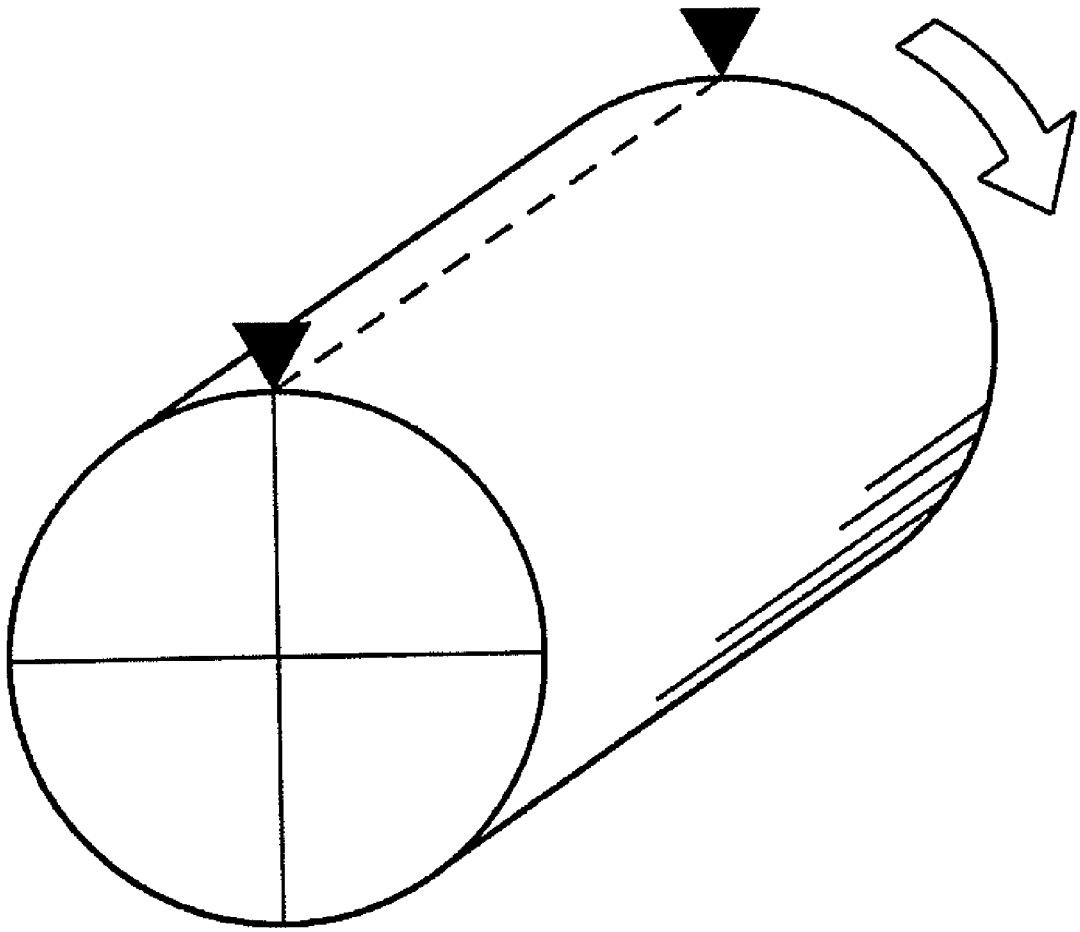
FIG. 5 is a diagram illustrating an example of a predetermined position of the photoreceptor.

In the exemplary embodiment, in both cases in which the belt-shaped image is formed and the belt-shaped image is not formed, the image quality adjusting image is controlled to be always started to be formed from a predetermined position (e.g., the position indicated by triangular marks in FIG. 5) in the rotational direction of the photoreceptor 21.

Next, an operation of the image forming apparatus 10 will be described with reference to FIGS. 6A to 6C.

Figure 6A:
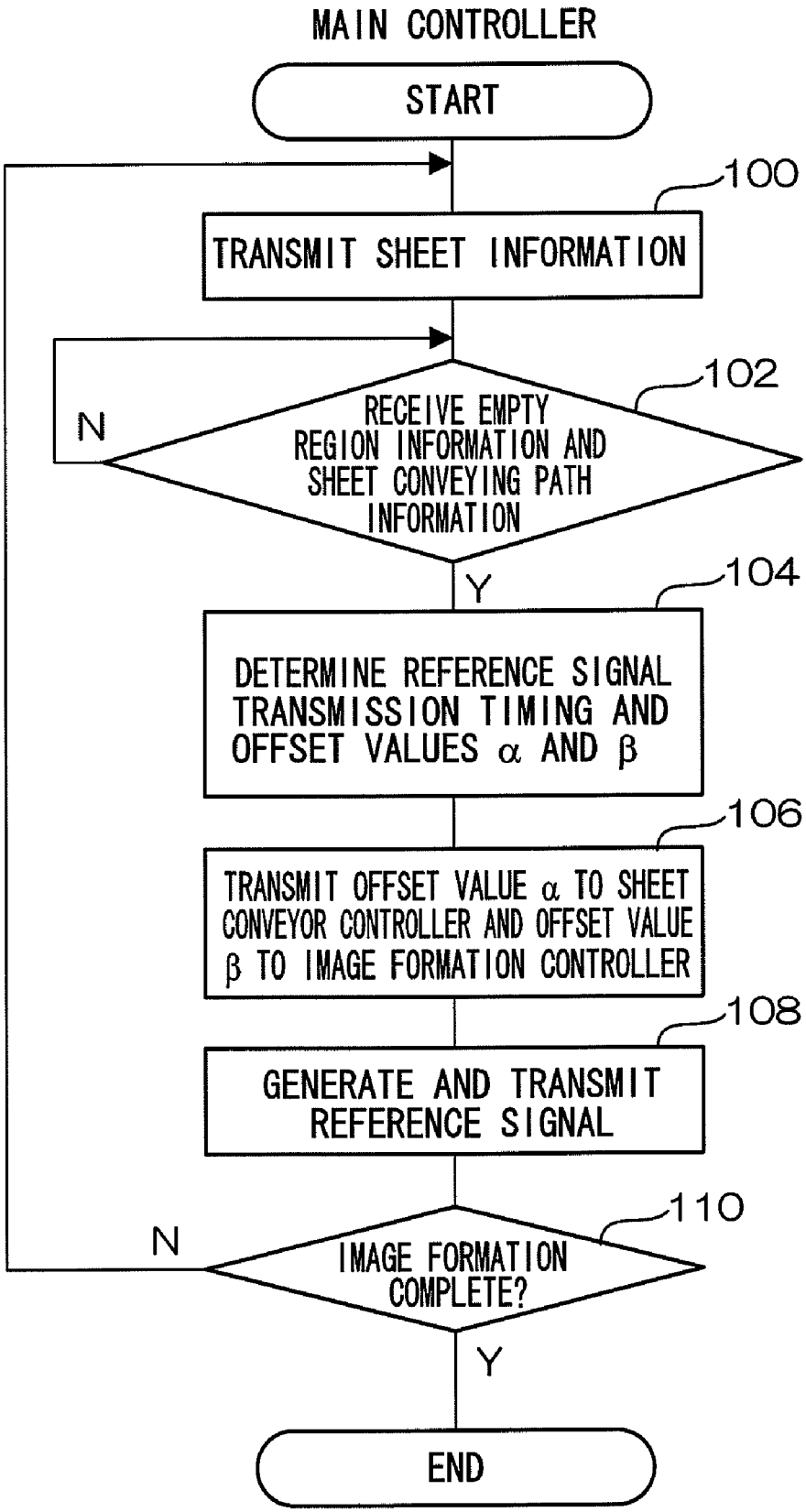
FIG. 6A is a flowchart illustrating an example of control flow performed in a main controller of the image forming apparatus.
Figure 6B:
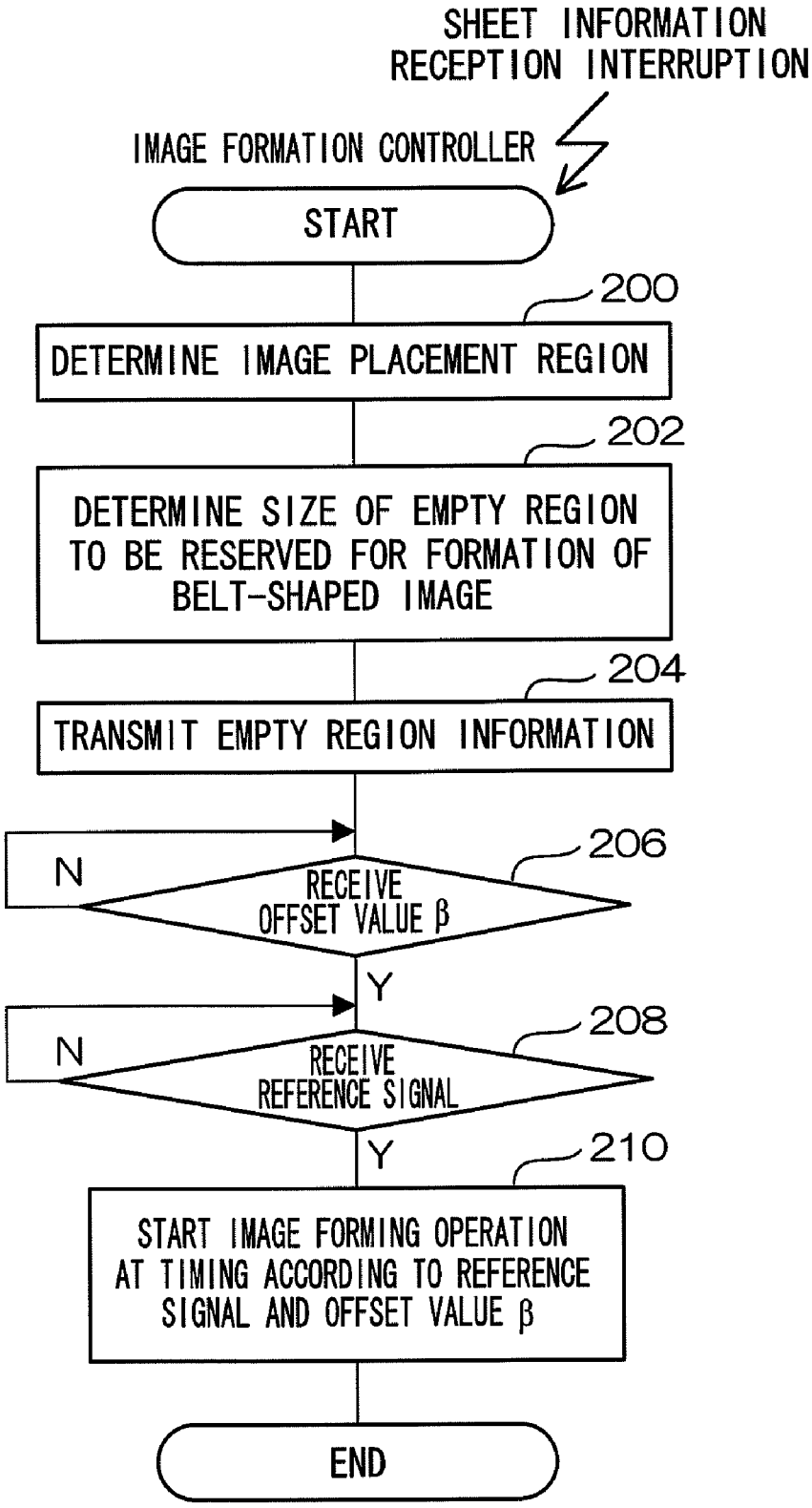
FIG. 6B is a flowchart illustrating an example of control flow performed in an image formation controller.
Figure 6C:
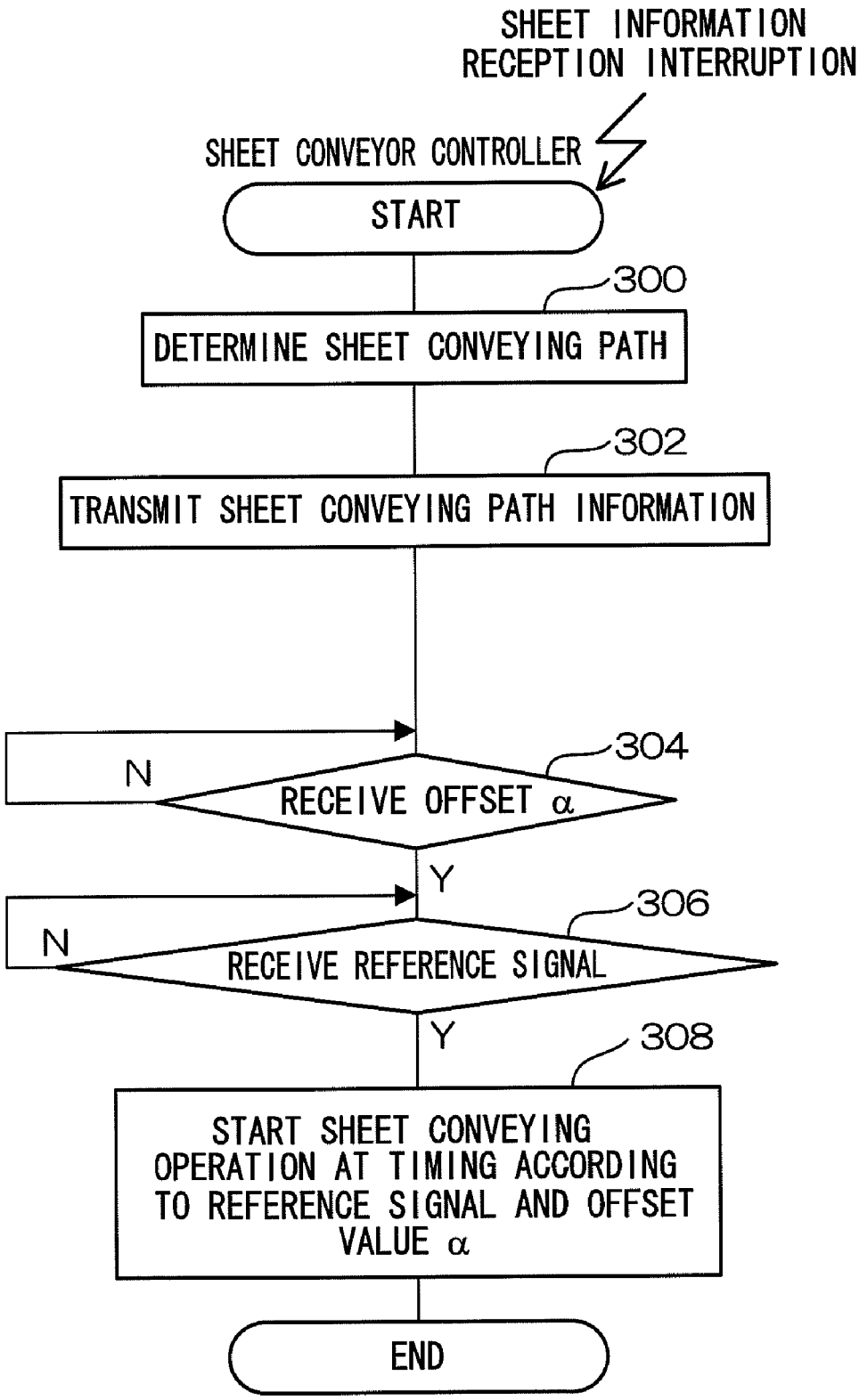
FIG. 6C is a flowchart illustrating an example of control flow performed in a sheet conveyor controller.

FIGS. 6A to 6C are flowcharts showing a control flow performed by the main controller 50, the sheet conveyor controller 52, and the image formation controller 54 of the image forming apparatus 10.

As shown in FIG. 6A, in step 100, the main controller 50 transmits, to the sheet conveyor controller 52 and the image formation controller 54, sheet information indicating the size of a sheet onto which the recorded image is transferred.

When the image formation controller 54 receives the sheet information from the main controller 50, the image formation controller 54 starts to execute the process shown in FIG. 6B. When the sheet conveyor controller 52 receives the sheet information from the main controller 50, the sheet conveyor controller 52 starts to execute the process shown in FIG. 6C.

As shown in FIG. 6B, in step 200, the image formation controller 54 determines the size of the image placement region virtually set at the photoreceptor 21 based to the sheet information received from the main controller 50. A table storing sizes of the sheet and sizes of the image placement region in association with each other may be stored in the ROM 60 of the image formation controller 54, and the determination may be carried out according to the table.

In step 202, the size of an empty region to be reserved for the formation of the belt-shaped image (here, a width in the rotational direction of the photoreceptor 21) is determined. Specifically, when the condition of forming the belt-shaped image is not satisfied, the empty region for forming the belt-shaped image is unnecessary and, therefore, the size of the empty region is determined to be zero. When the condition of forming the belt-shaped image is satisfied, the size of the empty region necessary for forming the belt-shaped image is determined based on the determined image placement region.

In this case, in order to discharge the developers as much as possible, a width obtained by subtracting the width of the image quality adjusting image region, the width w of the predetermined space region, and the width of the recorded image region from the width of the determined image placement region in the rotational direction of the photoreceptor is determined as the empty region.

In step 204, the image formation controller 54 transmits to the main controller 50 empty region information indicating the size of the determined empty region.

As shown in FIG. 6C, in step 300, the sheet conveyor controller 52 determines the sheet conveying path according to the sheet information received from the main controller 50. As described above, the storage 14 has the first storage portion 14*a*, the second storage portion 14*b*, and the third storage portion 14*c*. When the sizes of sheets stored in the first storage portion 14*a*, the second storage portion 14*b*, and the third storage portion 14*c* are different, the storage portion from which the sheet is taken out is also different according to the size of the sheet on which the recorded image is to be transferred. Further, even if all of the storage portion 14*a*, the second storage portion 14*b*, and the third storage portion 14*c* store the same size of sheets, a priority of sheet taking-out order may be set in advance for the storage portions. Since movements of the sheet feeding roll 41 are determined according to which storage portion the sheet is taken out from, in step 300, the sheet conveyor controller 52 determines which storage portion the sheet is to be taken out from.

In step 302, the sheet conveyor controller 52 transmits information on the determined sheet conveying path to the main controller 50. In some apparatuses, time required for conveying the taken-out sheet to the transfer position of the secondary transferring device 28 may be different depending on which storage portion the sheet is taken out from (see FIG. 1). In this case, the main controller 50 adjusts a sheet conveying operation start time (the detail will be described later) of the sheet conveyor 40 based to the sheet conveying path information. The sheet conveying controller 52 transmits the sheet conveying path information to the main controller 50.

As shown in FIG. 6A, in step 102, the main controller 50 determines whether the sheet conveying path information is received from the sheet conveyor controller 52. If it is determined that the empty region information is also received from the image formation controller 54, in step 104, based on the received sheet conveying path information and the empty region information, a transmission time of a reference signal which is transmitted to the sheet conveyor controller 52 and the image formation controller 54 and offset values $\alpha$ and $\beta$ for the reference signal are determined. Details of the reference signal and the offset values will be described later.

In step 106, the main controller 50 transmits the determined offset value $\alpha$ to the sheet conveyor controller 52 and the determined offset value $\beta$ to the image formation controller 54.

In step 108, the main controller 50 generates and transmits the reference signal at the determined transmission time to the sheet conveyor controller 52 and the image formation controller 54.

In step 110, the main controller 50 determines whether or not the entire image formation is completed. If it is determined that the image formation is not completed, the routine returns to step 100, sheet information indicating the size of a sheet for recording the next recorded image is generated and transmitted, and the same process as described above is repeated.

In the meantime, as shown in FIG. 6B, after transmitting the empty region information in step 204, the image formation controller 54 waits for reception of the offset value $\beta$ in step 206. If it is determined that the offset value $\beta$ is received in step 206, the image formation controller 54 waits for reception of the reference signal in step 208.

If it is determined that the reference signal is received in step 208, the image formation controller 54 controls the image formation unit 20 in step 210 so as to start an image forming operation at a time according to the reference signal and the offset value $\beta$. Specifically, the image formation controller 54 controls the image formation unit 20 so as to start the image forming operation at a time after a time period indicated by the offset value $\beta$ has elapsed after the reference signal has been received.

Further, as shown in FIG. 6C, after transmitting the sheet conveying path information in step 302, the sheet conveyor controller 52 waits for reception of the offset value $\alpha$ in step 304. If it is determines that the offset value $\alpha$ is received in step 304, the sheet conveyor controller 52 waits for reception of the reference signal in step 306.

If it is determined that the reference signal is received in step 306, the image conveyor controller 52 controls the sheet conveyor 40 in step 308 so as to start the sheet conveying operation at a time according to the reference signal and the offset value $\alpha$. Specifically, the sheet conveyor controller 52 controls the sheet conveyor 40 so as to start the sheet conveying operation at a time after a time period indicated by the offset value $\alpha$ has elapsed after the reference signal.

Timing control method of the main controller 50 will be described in detail with references to FIGS. 7 and 8.

Firstly, a timing control method in a case in which the belt-shaped image is not formed will be described. As described above, the empty region information is transmitted from the image formation controller 54 to the main controller 50 in step 204. If the empty region information indicates 0, the main controller 50 determines that the belt-shaped image is not formed, and determines the reference signal transmission time and the offset values α and β corresponding to the case in which the belt-shaped image is not formed (step 104).

Figure 7:
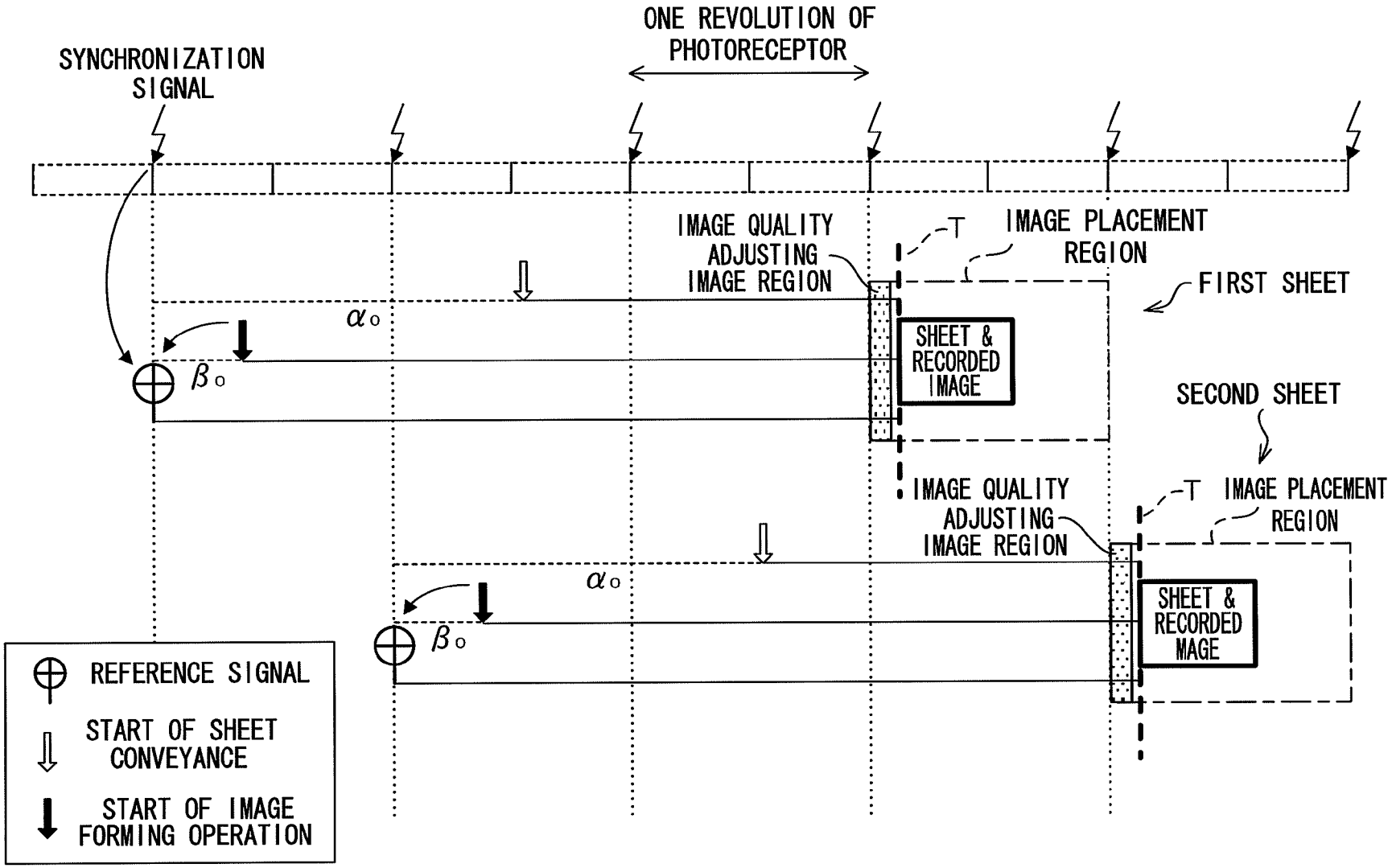
FIG. 7 is a timing chart illustrating a timing control method in the case in which a belt-shaped image is not formed.

FIG. 7 is a timing chart explaining the timing control method in the case in which the belt-shaped image is not formed. FIG. 7 illustrates an example in which the image placement region having a width of one revolution of the photoreceptor 21 is virtually set.

The image forming apparatus 10 includes a signal generating circuit, which is not illustrated. The signal generating circuit generates a synchronization signal in each one revolution of the photoreceptor. Thus, the synchronization signal is generated when the predetermined position in the rotational direction of the photoreceptor 21 shown in FIG. 5 reaches a specified rotation position. The specified rotation position may be a position where the laser beam of the laser beam emission unit 23 is emitted.

In the exemplary embodiment, the image placement region is virtually set according to the synchronization signal so that the leading end (one side of a pair of sides of the image placement region which are orthogonal to the rotational direction of the photoreceptor, and which the one side is at the upstream side in the rotational direction) is substantially aligned with the predetermined position. The image quality adjusting image region is arranged at the leading end of the image placement region. The recorded image region is arranged at the downstream side in the rotational direction of the photoreceptor than the image quality adjusting image region.

The image formation controller 54 controls the image formation unit 20 to start the image forming operation of forming each of the images in each of the arranged positions in the image placement region. The sheet conveyor controller 52 controls the sheet conveyor 40 to start the sheet conveyance corresponding to the time at which the recorded image formed at the arranged position is transferred onto the intermediate transfer member 27 and reaches the transfer position of the secondary transferring device 28 due to the rotation of the intermediate transfer member 27.

In the exemplary embodiment, the start time of the sheet conveying operation of the sheet conveyor 40 and the start time of the image forming operation of the image formation unit 20 are determined by using time T (hereinafter, referred to as secondary transfer time T) at which the transfer of the recorded image onto the sheet is started at the transfer position of the secondary transferring device 28 as a reference.

In FIG. 7, times indicated by white arrows are the sheet conveying operation start timing and times indicated by black arrows are the image forming operation start timing.

As described above, the width of the image quality adjusting image region in the rotational direction of the photoreceptor is constant and the recorded image is formed at a position spaced from the image quality adjusting image region by the space region of the predetermined width w. Accordingly, in the case in which the belt-shaped image is not formed, the secondary transfer time T can be determined when the image placement region is virtually set.

The image forming operation of the image formation unit 20 includes, not only an operation actually forming an image on the photoreceptor 21, but also various operations such as preparation operations (for example, applying the charging bias to the charging device 22 to charge the photoreceptor 21, applying the developing bias to the developing device 24, and the like) and a transferring operation of the primary transferring device 25. By using the secondary transfer time T as the reference, the image forming operation start time of the image formation unit 20 is determined based on an operation, among the various operations included in the image forming operation, that is need to be started at the earliest time, such that, the image which should be formed at first (i.e., the image arranged at the most upstream position in the rotational direction of the photoreceptor 21, in the exemplary embodiment, the image quality adjusting image), among the images arranged in the image placement region, is formed at the above position.

Information on the operations included in the image forming operation (such as information on required time for the operations, and operation order) is stored in the ROM 60 of the main controller 50. The main controller 50 may determine the image forming operation start time according to this information.

Further, the sheet conveying operation of the sheet conveyor 40 also includes various operations such as operations of rotating the sheet feeding roll 41, the conveying rolls 42 and 44. Accordingly, by using the secondary transfer time T as the reference, the sheet conveying operation start time of the sheet conveyor 40 is determined based on an operation, among these operations, that is need to be started at the earliest time.

Information on the operations included in the sheet conveying operation (such as information on required time for the operations, and an operation order) is stored in the ROM 60 of the main controller 50. The main controller 50 may determine the sheet conveying operation start time according to this information and the sheet conveying path information received from the sheet conveyor controller 52.

The image forming operation start time and the sheet conveying operation start time are controlled by transmitting the reference signal and the offset values α and β for the reference signal from the main controller 50 to the image formation unit 20 and the sheet conveyer 40.

The reference signal is a signal that serves as a reference for starting the operations of the image formation unit 20 and the sheet conveyor 40. The reference signal is generated in synchronization with any one of the synchronization signals which are periodically generated, and is transmitted to the sheet conveyor controller 52 and the image formation controller 54. In the exemplary embodiment, the reference signal is generated in synchronization with the synchronization signal which is sent before the earliest one of the sheet conveying operation start time and the image formation operation start time, and which is also closest to the earliest one of the sheet conveying operation start time and the image forming operation start time. That is, the reference signal is generated at a time synchronized with a synchronization signal which is close to one of the sheet conveying operation start time and the image forming operation start time, such that the start of both of these operations can be ensured.

The offset value α is a value indicating a difference from the reference signal and the time at which a time period of the offset value α has elapsed after the reference signal is to be the sheet conveying operation start time of the sheet conveyor 40. The offset value β is a value indicating a difference from the reference signal and the time at which a time period of the offset value β has elapsed after the reference signal is to be the image forming operation start time of the image formation unit 20.

The main controller 50 determines the offset values and the time of generating and transmitting the reference signal based on the sheet conveying operation start time and the image forming operation start time and using the secondary transfer time T as the reference (step 104).

The determined offset values are transmitted to the sheet conveyor controller 52 and the image formation controller 54, and then the reference signal is generated and transmitted in synchronization with the synchronization signal generated at the time which is determined as described above (steps 106 and 108).

In the example illustrated in FIG. 7, the same offset value for the reference signal is set to the first sheet and the second sheet, and the image quality adjusting image of the first sheet and the image quality adjusting image of the second sheet are controlled to be formed from the same position (the predetermined position) in the rotational direction of the photoreceptor 21. When the sheet conveying paths are different between the first and second sheets, the offset value $\alpha$ transmitted to the sheet conveyor controller 52 may be changed. However, even in this case, the position of the image quality adjusting image region with respect to the rotational direction of the photoreceptor 21 will not be changed by setting the image placement region and performing timing control as described above.

Next, a timing control method in a case in which the belt-shaped image is formed will be described. As described above, if the empty region information transmitted from the image formation controller 54 to the main controller 50 in step 204 does not indicate 0, the main controller 50 determines that the belt-shaped image is formed by the image formation unit 20, and determines the reference signal transmission time and the offset values $\alpha$ and $\beta$ corresponding to the case in which the belt-shaped image is formed (step 104).

Figure 8:
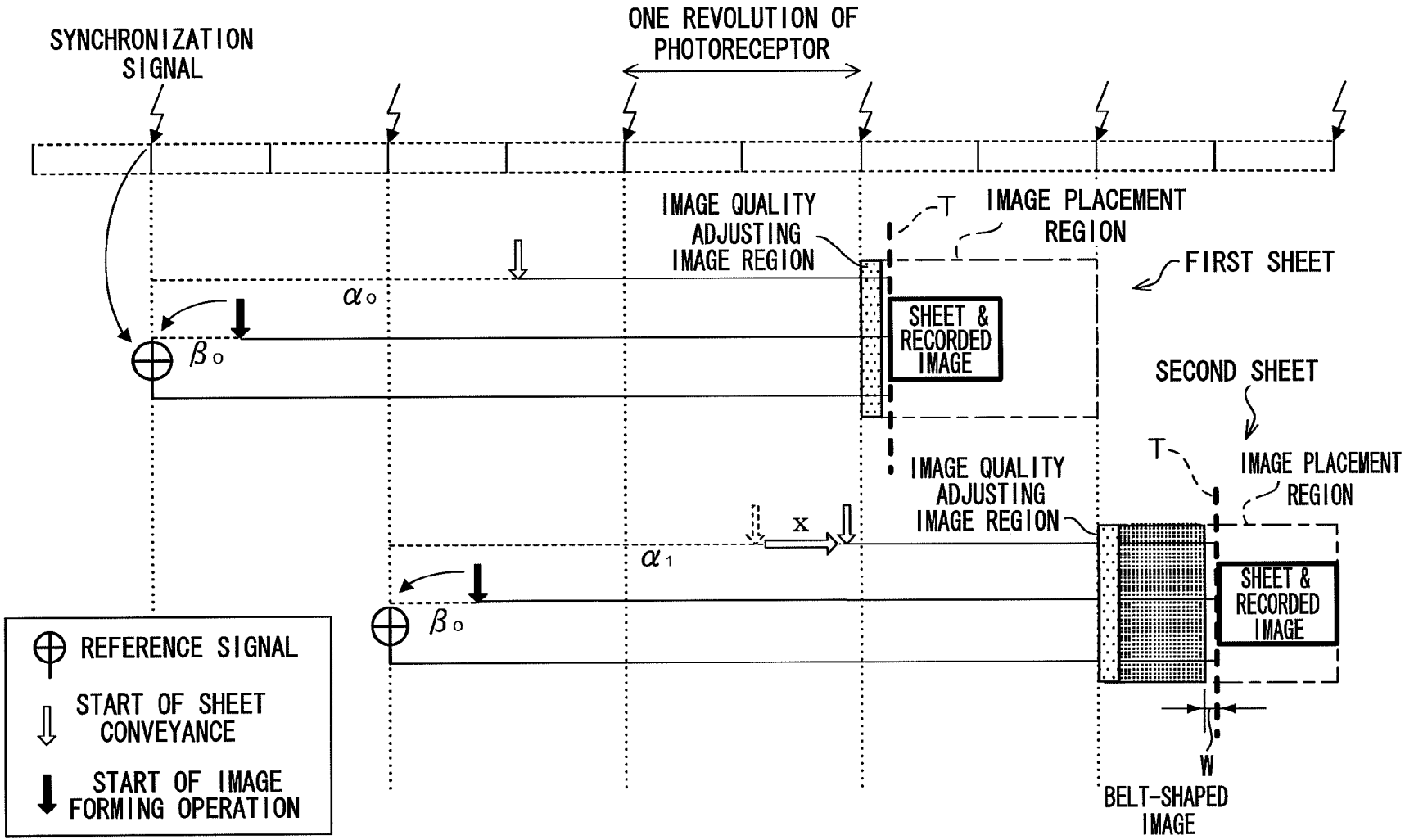
FIG. 8 is a timing chart illustrating a timing control method in the case in which the belt-shaped image is formed.

FIG. 8 is a timing chart explaining the timing control method in the case in which the belt-shaped image is formed. FIG. 8 illustrates arrangements and timing charts of the image placement region of the first sheet in which the belt-shaped image is not formed and the image placement region of the second sheet in which the belt-shaped image is formed.

As in the case in which the belt-shaped image is not formed, when the belt-shaped image is formed, the image placement region is virtually set according to the synchronization signal so that the leading end (one side of a pair of sides of the image placement region which are orthogonal to the rotational direction of the photoreceptor, which the one side is at the upstream side in the rotational direction) is substantially aligned with the predetermined position. In this example, the image quality adjusting image, the belt-shaped image, and the recorded image are formed in this order from the upstream side along the rotational direction of the photoreceptor 21 in the set image placement region.

Due to the belt-shaped image thus arranged, the secondary transfer time T of the image placement region of the second sheet is shifted from the secondary transfer time T for the first sheet of FIG. 8 in which the belt-shaped image is not formed. The main controller 50 calculates a time shift x of the secondary transfer time T based on the width in the rotational direction of the empty region in which the belt-shaped image is arranged (the width indicated by the empty region information received from the image formation controller 54) and an image forming speed of the image formation unit 20.

Further, due to the shift of the secondary transfer time T, the main controller 50 changes the offset value $\alpha$ that defines the sheet conveying operation start time. Specifically, the offset value $\alpha$ is determined so that the sheet conveying operation start time is delayed by the calculated shift x (in the example illustrated in FIG. 8, the offset value $\alpha$ is changed from $\alpha_0$ to $\alpha_1$). When the sheet conveying path is changed, the offset value $\alpha$ is determined by also taking into consideration of the changed sheet conveying path.

Although the period from the image forming operation start time of the image quality adjusting image to the secondary transfer time T is increased by the shift x, the offset value defining the image forming operation start time is not changed. This is because the forming position of the image quality adjusting image is not changed.

The transmission time of the reference signal is determined as described in relation to FIG. 7.

Then, the determined offset values are transmitted to the sheet conveyor controller 52 and the image formation controller 54, and the reference signal is generated and transmitted in synchronization with the synchronization signal generated at the time determined as described above (steps 106 and 108).

In the above exemplary embodiment, a case in which the image forming operation start time is earlier than the sheet conveying operation start time has been described. However, embodiments are not limited to this and, depending on the apparatus, the sheet conveying operation start time may be earlier than the image forming operation start time. Also in the latter case, the timing can be controlled by the above described procedure.

Further, in the above exemplary embodiment, an example in which the main controller 50, the sheet conveyor controller 52, and the image formation controller 54 work in coordination to control the operation of the image forming apparatus 10. However, embodiments are not limited to this and, the main controller 50 alone may control the entire operation of the image forming apparatus 10.

What is claimed is:

1. An image forming apparatus comprising:

an image formation unit that comprises a rotating photoreceptor, a latent image formation unit that forms an electrostatic latent image of a recorded image on the photoreceptor, a developing unit that develops the electrostatic latent image using a developer, a first transfer unit that transfers the developed image from the photoreceptor to a receiving member, and a second transfer unit that transfers the image on the receiving member to a recording medium at a transfer position;

a conveying unit that conveys the recording medium to the transfer position; and a controller that performs control when a belt-shaped image is formed on the photoreceptor, or when the belt-shaped image is not formed the photoreceptor, the belt-shaped image forcefully discharging the developer in the developing unit from the developing unit, the belt-shaped image not being transferred onto the recording medium, the control including:

(A) controlling the image forming unit such that formation of an image quality adjusting image that is not transferred to the recording medium starts from a predetermined position in a rotational direction of the photoreceptor, and such that the recorded image is formed further downstream in the rotational direction of the photoreceptor than an image quality adjusting image region in which the image quality adjusting image is formed; and (B) controlling the conveying unit such that the recorded image is transferred onto the recorded medium at the transfer position by the second transfer unit, wherein the control (A) of the controller further includes:

virtually setting on the photoreceptor a rectangular image placement region having a size determined in accordance with a size of the recording medium;

when forming the recorded image, the image quality adjusting image, and the belt-shaped image in the image placement region, arranging a pair of sides of the image placement region which are orthogonal to the rotational direction, such that the side which is at the upstream side in the rotational direction is substantially aligned with a leading end of the image quality adjusting image region; and forming the belt-shaped image in an empty region that is formed when a trailing end of the recorded image at the downstream side in the rotational direction is substantially aligned with the side of the image placement region which is opposite to the side at the upstream side.

2. A non-transitory computer-readable storage medium storing a program that causes an image forming apparatus, that includes a photoreceptor and that forms a recorded image on a recording medium using a developer, to execute an image processing, the image processing comprising:

when a belt-shaped image that forcefully discharges the developer and is not transferred onto the recording medium is formed on the photoreceptor, or when the belt-shaped image is not formed thereon, forming an image quality adjusting image that is not transferred onto the recording medium from a predetermined position in a rotational direction of the photoreceptor;

forming the recorded image at the downstream side in the rotational direction from an image quality adjusting image region in which the image quality adjusting image is formed; and transferring the recorded image to the recording medium at the predetermined transfer position, the image processing further comprising:

virtually setting on the photoreceptor a rectangular image placement region having a size determined in accordance with the size of the recording medium;

when forming the recorded image, the image quality adjusting image, and the belt-shaped image in the arranged image placement region, arranging a pair of sides of the image placement region which are orthogonal to the rotational direction, such that the side which is at the upstream side in the rotational direction is substantially aligned with a leading end of the image quality adjusting image region; and forming the belt-shaped image in an empty region that is formed when a trailing end of the recorded image at the downstream side in the rotational direction is substantially aligned with the side of the image placement region which is opposite to the side at the upstream side.

3. A method of operating an image forming apparatus that includes a photoreceptor and forms a recorded image on a recording medium using a developer, the method comprising:

when a belt-shaped image that forcefully discharges the developer and is not transferred onto the recording medium is formed on the photoreceptor, or when the belt-shaped image is not formed thereon:

forming an image quality adjusting image that is not transferred onto the recording medium from a predetermined position in the rotational direction of the photoreceptor;

forming the recorded image that is transferred onto the recording medium at the downstream side in the rotational direction of the photoreceptor from the region at which the image quality adjusting image is formed;

transferring the recorded image onto the recording medium at the predetermined transfer position;

virtually setting on the photoreceptor a rectangular image placement region having a size determined according to the size of the recording medium;

when forming the recorded image, the image quality adjusting image, and the belt-shaped image in the arranged image placement region, arranging a pair of sides of the image placement region which are orthogonal to the rotational direction, such that the side which is at the upstream side in the rotational direction is substantially aligned with a leading end of the image quality adjusting image region; and forming the belt-shaped image in an empty region that is formed when a trailing end of the recorded image at the downstream side in the rotational direction is substantially aligned with the side of the image placement region which is opposite to the side at the upstream side.

4. An image forming device comprising:

a controller configured to virtually set on a photoreceptor a rectangular image placement region having a size determined according to a size of a recording medium;

wherein the controller is configured to control the image forming device to:

form an image quality adjusting image that is not transferred onto the recording medium, from a predetermined position in a rotational direction of the photoreceptor;

form a recorded image that is transferred onto the recording medium, at a downstream side in the rotational direction of the photoreceptor from a region at which the image quality adjusting image is formed; and transfer the recorded image onto the recording medium at the predetermined transfer position, and wherein an upstream side of the image placement region in the rotational direction of the photoreceptor is substantially aligned with a leading end of the image quality adjusting image region.

5. An image forming apparatus comprising:

an image formation unit that comprises a rotating photoreceptor, a latent image formation unit that forms an electrostatic latent image of a recorded image on the photoreceptor, a developing unit that develops the electrostatic latent image using a developer, a first transfer unit that transfers the developed image from the photoreceptor to a receiving member, and a second transfer unit that transfers the image on the receiving member to a recording medium at a transfer position;

a conveying unit that conveys the recording medium to the transfer position; and a controller that performs control when a belt-shaped image is formed on the photoreceptor, or when the belt-shaped image is not formed the photoreceptor, the belt-shaped image forcefully discharging the developer in the developing unit from the developing unit, the belt-shaped image not being transferred onto the recording medium, the control including:

(A) controlling the image forming unit such that formation of an image quality adjusting image that is not transferred to the recording medium starts from a predetermined position in a rotational direction of the photoreceptor such that a leading end of the image quality adjusting image starts from substantially the same position in the rotational direction of the photoreceptor for each formation of the image quality adjusting image, and such that the recorded image is formed further downstream in the rotational direction of the photoreceptor than an image quality adjusting image region in which the image quality adjusting image is formed; and (B) controlling the conveying unit such that the recorded image is transferred onto the recorded medium at the transfer position by the second transfer unit.

6. A non-transitory computer-readable storage medium storing a program that causes an image forming apparatus, that includes a photoreceptor and that forms a recorded image on a recording medium using a developer, to execute an image processing, the image processing comprising:

when a belt-shaped image that forcefully discharges the developer and is not transferred onto the recording medium is formed on the photoreceptor, or when the belt-shaped image is not formed thereon, forming an image quality adjusting image that is not transferred onto the recording medium from a predetermined position in a rotational direction of the photoreceptor such that a leading end of the image quality adjusting image starts from substantially the same position in the rotational direction of the photoreceptor each time the image quality adjusting image is formed;

forming the recorded image at the downstream side in the rotational direction from an image quality adjusting image region in which the image quality adjusting image is formed; and transferring the recorded image to the recording medium at the predetermined transfer position.

7. A method of operating an image forming apparatus that includes a photoreceptor and forms a recorded image on a recording medium using a developer, the method comprising:

when a belt-shaped image that forcefully discharges the developer and is not transferred onto the recording medium is formed on the photoreceptor, or when the belt-shaped image is not formed thereon:

forming an image quality adjusting image that is not transferred onto the recording medium from a predetermined position in a rotational direction of the photoreceptor such that a leading end of the image quality adjusting image starts from substantially the same position in the rotational direction of the photoreceptor each time the image quality adjusting image is formed;

forming the recorded image that is transferred onto the recording medium at the downstream side in the rotational direction of the photoreceptor from the region at which the image quality adjusting image is formed; and transferring the recorded image onto the recording medium at the predetermined transfer position.

* * * * *